US009077131B2

(12) United States Patent
Hida et al.

(10) Patent No.: US 9,077,131 B2
(45) **Date of Patent: *Jul. 7, 2015**

(54) COAXIAL CONNECTOR

(71) Applicant: Hirose Electric Co., Ltd., Tokyo (JP)

(72) Inventors: Kohei Hida, Tokyo (JP); Daisuke Yamakoshi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 120 days.

This patent is subject to a terminal disclaimer.

(21) Appl. No.: 13/911,509

(22) Filed: Jun. 6, 2013

(65) Prior Publication Data

US 2014/0287606 A1 Sep. 25, 2014

(30) Foreign Application Priority Data

Mar. 19, 2013 (JP) ..... 2013-056270

(51) Int. Cl.
*H01R 24/46* (2011.01)
*H01R 24/50* (2011.01)
*H01R 103/00* (2006.01)

(52) U.S. Cl.
CPC ..... *H01R 24/46* (2013.01); *H01R 2103/00* (2013.01); *H01R 24/50* (2013.01)

(58) Field of Classification Search
CPC ..... H01R 2103/00; H01R 13/7032; H01R 24/46; H01R 24/50; H01R 12/7094
USPC ..... 439/188, 63, 581
See application file for complete search history.

(56) References Cited

U.S. PATENT DOCUMENTS

| | | | | |
|---|---|---|---|---|
| 8,038,450 | B2 * | 10/2011 | Nakagawa | 439/63 |
| 8,444,422 | B2 * | 5/2013 | Lin | 439/63 |
| 8,535,074 | B2 * | 9/2013 | Hirakawa et al. | 439/188 |
| 2013/0303008 | A1 * | 11/2013 | Hida et al. | 439/188 |

FOREIGN PATENT DOCUMENTS

| | | |
|---|---|---|
| JP | 2007-141665 A | 6/2007 |
| JP | 2008-226588 A | 9/2008 |

* cited by examiner

*Primary Examiner* — Xuong Chung Trans
(74) *Attorney, Agent, or Firm* — Kubotera & Associates, LLC

(57) ABSTRACT

A coaxial connector includes an insulation housing having a receptacle opening portion for receiving a central conductive member of a coaxial plug; an outer conductive member for detachably attaching an outer conductive member of the coaxial plug; a connection member; a switching spring member capable of being elastically deformed downwardly; and an insulation member fixed to the connection member or the switching spring member so that the insulation member is situated between the connection member and the switching spring member. The switching spring member is pushed and displaced so that the switching spring member is disconnected from the connection member when the coaxial plug is inserted into the insulation housing. The connection member is pushed to displace the switching spring member through the insulation member so that the switching spring member is disconnected from the connection member when the coaxial plug is inserted into the insulation housing.

8 Claims, 15 Drawing Sheets

COAXIAL CONNECTOR

BACKGROUND TECHNOLOGY AND RELATED TECHNOLOGY

The present invention relates to a coaxial connector for mounting on a substrate. In particular, the present invention relates to a coaxial connector with a switch, which is equipped with a switching mechanism for switching a high-frequency signal circuit, an antenna, and the like.

In a portable information communication device such as a cellular phone, a handheld-type computer, and a tablet-type computer, a conventional coaxial connector with a switch has been widely used for inspecting a built-in high-frequency circuit thereof. The conventional coaxial connector with a switch includes, for example, an insulation housing having a hole that can receive a central conductive member of a coaxial plug; an outer conductive member provided outside the insulation housing; and a stationary terminal and a movable terminal provided under the hole. Furthermore, while the stationary terminal includes a contact section, the movable terminal includes a securing section to be secured on the insulation housing, and an elastic section that can touch the central conductive member of the coaxial plug and contact with the contact section (for example, refer to Patent Reference 1).

Patent Reference 1: Japanese Patent Publication No. 2007-141665

In case of the conventional coaxial connector with a switch, when a coaxial plug is not attached thereto, the movable terminal is pressed onto a contact section of the stationary terminal by elastic force of the elastic section, and the stationary terminal and the movable terminal keep the electrically connected state. On the other hand, when the coaxial plug is attached thereto, a lower end of the central conductive member of the coaxial plug is put through a vertical hole of the connector. In this state, the central conductive member touches the elastic section, and the elastic section is pressed down by and end part of the central conductive member to elastically deform, and moves away from the contact section. The stationary terminal and the movable terminal are electrically disconnected from each other, and at the same time, the central conductive member and the movable terminal are in electrically connected state. As such, signals, which flew from the movable terminal to the stationary terminal, are made flow from the movable terminal to the central conductive member and thereby it is possible to inspect a high-frequency circuit connected to the movable terminal.

In these years, there have been increased demands to measure or inspect both high-frequency circuits, and antennas, etc. of portable information communication devices by switching therebetween. In case of a conventional coaxial connector with a switch, for inspection after mounting an integrated circuit, electronic component, or the like, it is possible to conduct inspection, for example, while temporarily disconnecting the antenna and connecting only to the high-frequency circuit, but it was impossible to conduct inspection while temporarily disconnecting the high-frequency circuit and connecting only to the antenna.

For this reason, it is necessary to develop a coaxial connector with a switch, whereby it is possible to switch to a plurality of terminals. As such a coaxial connector with a switch, both high-frequency circuit and antenna characteristics of which can be measured, for example, there is a technique described in Patent Reference 2.

Patent Reference 2: Japanese Patent Publication No. 2008-226588

According to the conventional coaxial connector with a switch described in Patent Reference 2, the plug includes a resin protrusion, and upon connector fitting, the resin protrusion touches to press down a first switch spring of a receptacle to shut off electrical connection with the first switch spring but keep electrical connection with a second switch spring, and adversely the resin protrusion touches to press down the second switch spring of the receptacle to shut off electrical connection with the second switch spring, but keep electrical connection with the first switch spring, so that electrical connection can be switched by changing the position of the resin protrusion of the plug.

However, the conventional coaxial connector with a switch described in Patent Reference 2 has a very complicated coaxial connector structure, and production efficiency is poor and the size is large. In addition, since a direction upon fitting a plug connector is fixed, it is very convenient to use.

Therefore, an object of the invention is to provide a coaxial connector with a switch, which can attain high productivity, requires less manufacturing cost, can be easily operated, is highly durable, and enables to switch among a plurality of terminals. This and further objects and novelties of the invention will be revealed from the description of the specification and accompanying drawings.

Further objects and advantages of the invention will be apparent from the following description of the invention.

SUMMARY OF THE INVENTION

In order to attain the objects described above, according to a first aspect of the present invention, a coaxial connector with a switch to be mounted on a substrate includes an insulation housing that has a hole that can receive a central conductive member of a coaxial plug from above; an outer conductive member that is provided outside the insulation housing and that the outer conductive member of the coaxial plug can be attached thereto and detached therefrom; a connection member that is provided so as to be exposed in the hole; and a switching spring member that is provided under the hole and also under the connection member and is capable of elastically displacing downward when the insulation housing receives the central conductive member of the coaxial plug.

According to the first aspect of the present invention, an insulation member is fixed while being in a state that the insulation member is engaged with at least one of the connection member and the switching spring member in the thickness direction, such that the insulation member is provided between the connection member and the switching spring member. It is configured such that the connection member is disconnected from the switching spring member, when the central conductive member of the coaxial plug is inserted therein so as to directly press the switching spring member to displace and separate therefrom, or press the connection member to indirectly displace and separate the switching spring member therefrom via the insulating member.

According to a second aspect of the present invention, a coaxial connector with a switch to be mounted on a substrate includes an insulation housing that has a hole that can a receive central conductive members of a first and a second coaxial plug from above; an outer conductive member that is provided outside the insulation housing and that outer conductive members of the first and second coaxial plug can be attached thereto and detached therefrom; a connecting plate that is provided under the hole and can elastically displace downward by receiving the central conductive member of the coaxial plug; and a switching spring member that is provided under the hole and also under the connecting plate and is capable of elastically displacing downward when the insulation housing receives the central conductive member of the coaxial plug.

According to the second aspect of the present invention, between the connecting plate and the switching spring member, there is provided an insulation member that is engaged and fixed to at least one of the connecting plate and the switching spring member in the thickness direction. The connecting plate has on an upper surface thereof a first contact section that contacts with an outer extending section of the central conductive member of the first coaxial plug when the central conductive member of the first coaxial plug is fitted in the hole of the insulation housing. Further, the switching spring member has on an upper surface thereof a second contact section that contacts with the central conductive member of the second coaxial plug when the central conductive member of the second coaxial plug is fitted in the hole of the insulation housing. The connecting plate has on a lower surface thereof a third contact section that contacts with a fourth contact section of the switching spring member, when any of the central conductive members of the first and the second coaxial plugs is not fitted in the hole of the insulation housing.

According to the present invention, there is provided the coaxial connector with a switch that can switch among a plurality of terminals. Further, it is possible to produce the coaxial connector at high productivity and low manufacturing cost. Further, it is possible to attain satisfactory operability without restriction on a rotational angle upon attaching the coaxial plug. Further, it is possible to attain high durability since the insulation member is fixed while being engaged with at least one of the connection member and the switching spring member in the thickness direction.

DETAILED DESCRIPTION OF THE PREFERRED EMBODIMENTS

Figure 1:
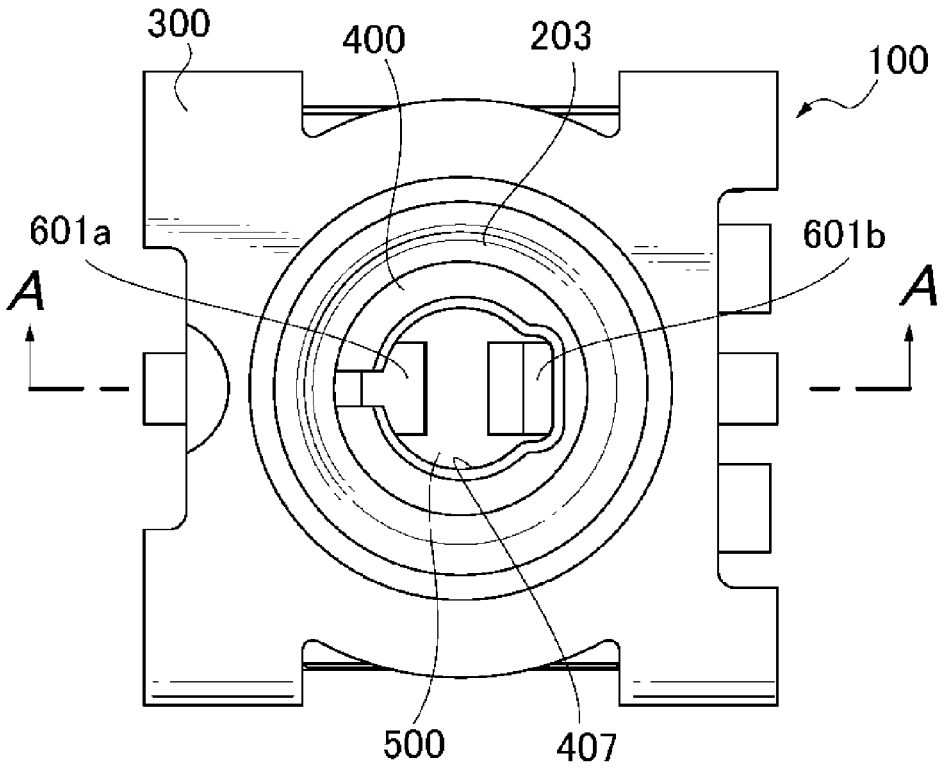
FIG. 1 is a top view showing a whole configuration of a coaxial connector according to an embodiment of the present invention.

Hereunder, referring to the accompanying drawings, embodiments of the present invention will be fully described.

Here, in any figure that describes embodiments of the present invention, the same reference numerals are basically used for the same members and repetitive description will be omitted. The following embodiments of the present invention will be described by dividing in several sections or embodiments as necessary for convenience, but unless clearly stated, those sections or embodiments are related to each other, i.e. modification of a part or whole thereof, details, supplemental description, etc. Moreover, in the embodiments below, an amount of elements (including numbers, numerical values, volumes, and range) may be specifically referred, unless clearly stated or except a case that the amount is obviously limited to a specific one in principle, such amount shall not be limited to the specific one and can be greater than the specific one.

Figure 2:
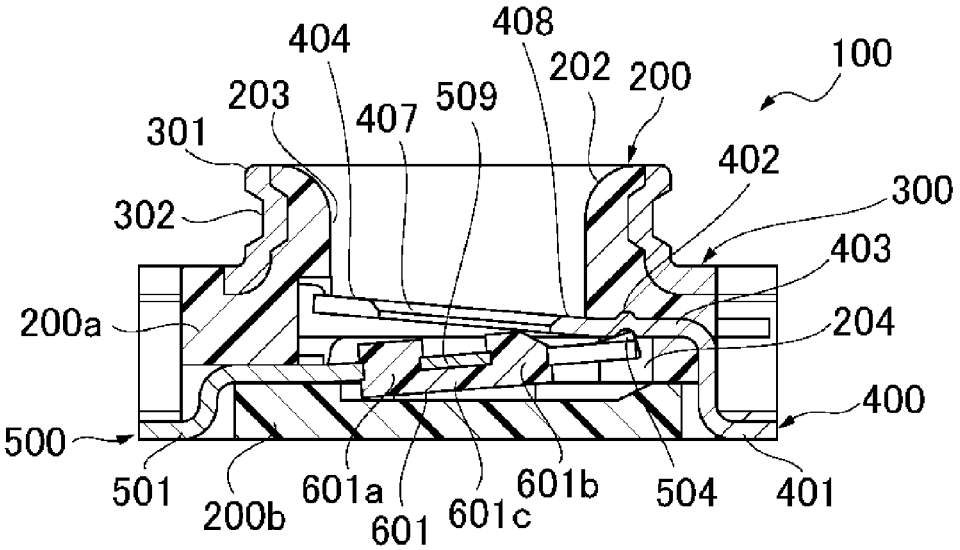
FIG. 2 is a sectional view of the coaxial connector taken along a line A-A of FIG. 1.
Figure 3:
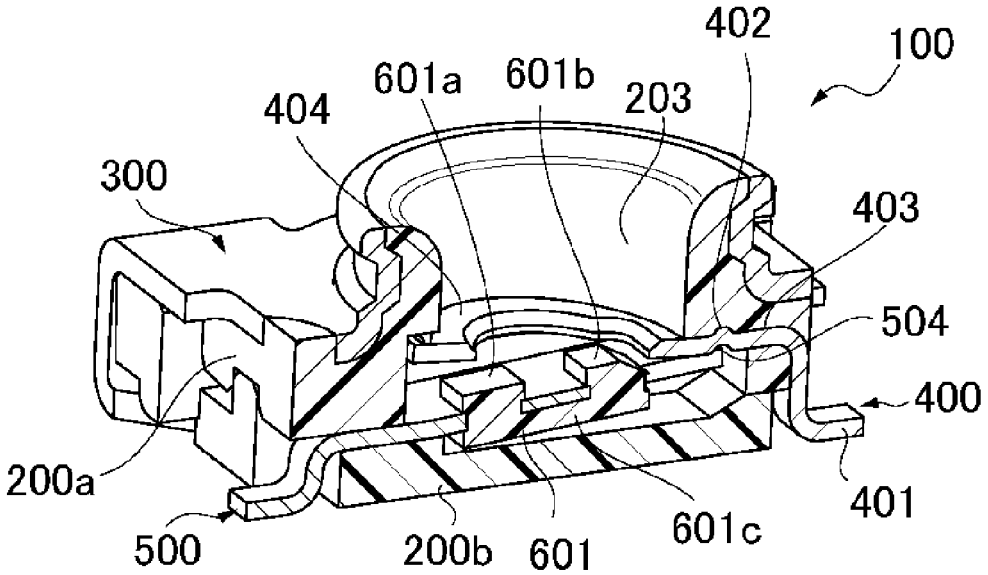
FIG. 3 is a perspective sectional view of the coaxial connector taken along the line A-A of FIG. 1.
Figure 4:
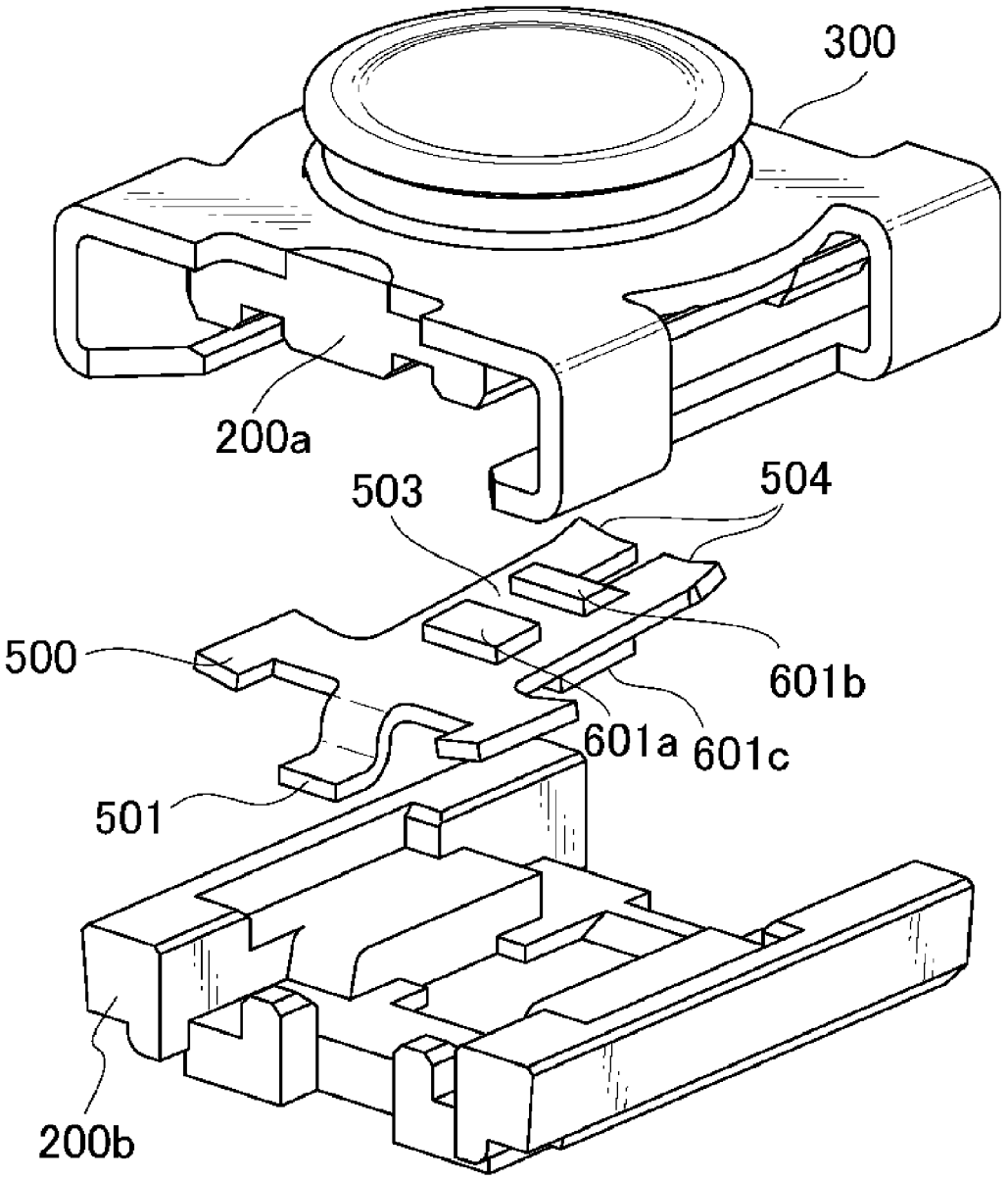
FIG. 4 is an exploded perspective view of the coaxial connector according to the embodiment of the present invention.

FIG. 1 is a top view showing a whole configuration of a coaxial connector according to an embodiment of the present invention; FIG. 2 is a sectional view taken along A-A of FIG. 1; FIG. 3 is a perspective sectional view taken along A-A of FIG. 1; and FIG. 4 is an exploded perspective view of the coaxial connector according to an embodiment of the present invention.

First, referring to FIGS. 1-4, a configuration of the coaxial connector according to the embodiment will be described. The coaxial connector 100 according to the embodiment is a coaxial connector with a switch for mounting on a substrate, and includes an insulation housing 200 (the insulation housing 200 is composed of an upper insulation housing 200*a* and a lower insulation housing 200*b*) having a vertical hole 203 that can receive a central conductive member 701*a* or 701*b* of a coaxial plug 700*a* or 700*b* (see FIGS. 16, 17, and other figures); an outer conductive member 300 that is provided outside the insulation housing 200 and that the outer conductive member 702 or 702*b* of the coaxial plug 700*a* or 700*b* can be attached/detached thereto/therefrom; a connecting plate 400 that is provided under the vertical hole 203; a switching spring member 500 that is provided under the vertical hole 203 and also under the connecting plate 400; and an insulation member 601 that is integrally formed on both surfaces of the switching spring member 500. The coaxial connector 100 can be mounted on a substrate, and being connected to a circuit of the substrate through a substrate connecting section 401 of the connecting plate 400 that is exposed outside or a substrate connecting section 501 of the switching spring member 500, the coaxial connector 100 can form a part of the substrate circuit.

In the embodiment, the coaxial connector 100 of the embodiment may be used for testing of characteristics, inspections, or the like of a built-in high-frequency circuit and an antenna in a portable information communication device such as cellular phones, smartphones, notebook computers, and tablet-type personal computers. Moreover, for high-frequency circuits, the outer conductive member 300 is shielded, and the connecting plate 400 and the switching spring member 500 are impedance-matched.

In the embodiment, the insulation housing 200 may be formed, for example, from insulating resin such as plastics. The insulation housing 200 has a main body part that is generally rectangular parallelepiped, and an upper part of generally center thereof has a cylindrical shape. In addition, on an upper surface of the insulation housing 200, there is formed a conical recess 202, and on a center part of a bottom surface of the recess 202, there is provided a vertical hole 203 that can receive the central conductive member 701*a* or 701*b* of the coaxial plug 700*a* or 700*b* from thereabove.

Furthermore, under the vertical hole 203, there is formed a horizontally long space 204 that connects to the vertical hole 203, and once the coaxial plug 700*a* or 700*b* is attached thereto, an end part of the central conductive member 701*a* or 701*b* goes through the vertical hole 203 and reaches the space 204. Here, the insulation housing 200 can be divided into, for example, two components (the upper insulation housing 200*a* and the lower insulation housing 200*b*), and has a configuration that is suitable for integrating the connecting plate 400, the switching spring member 500, and so on.

In the embodiment, the outer conductive member 300 may be formed, for example, by punching a conductive material such as sheet metal and then bending. On an upper surface of the outer conductive member 300, there is provided a cylindrical upper section 301. Upon inserting the coaxial plug, a lower end section of the outer conductive member 702*a* or 702*b* of the coaxial plug 700*a* or 700*b* touches the upper section 301, and becomes electrically connected to the outer conductive member 300 of the coaxial connector 100.

In addition, on an outer circumferential surface of the upper part 301 of the outer conductive member 300, there is formed an annular groove 302 having a semicircular shape in the sectional view thereof, such that, upon inserting another type of a coaxial plug (not illustrated), a lower end section of the outer conductive member 702*a* or 702*b* of the coaxial plug can be fitted in the annular groove 302.

In the embodiment, the connecting plate 400 may be formed, for example, by punching sheet metal of a conductive material, such as beryllium copper, phosphor bronze, ternary copper, and Corson copper and then bending. The connecting plate 400 includes a flat securing section 403; an extending section 404 that extends from the securing section 403 towards a center of the insulation housing 200; and a substrate connecting section 401 provided at an end section that is formed being bent downward from a basal end side of the securing sections 403.

In the embodiment, the extending section 404 has a circular hole 407 having a diameter smaller than that of the vertical hole 203, right under the vertical hole 203, such that a thin central conductive member 701*b* of the coaxial plug 700*b* can go therethrough. The securing section 403 is integrally molded in the space 204, while keeping its horizontal attitude, from a side of the insulation housing 200. As a result, the securing section 403 is fixed inside the insulation housing 200, and the substrate connecting section 401 remains in a state of being exposed to outside the insulation housing 200.

Moreover, in a generally middle part between the securing section 403 and the extending section 404, there is provided a contact section (third contact section) 402 that is depressed from the lower side to the upper side, so that the contact section (a fourth contact section) 504 of the switching spring member 500 slightly slides to contact thereto and thereby it is possible to enhance the contact reliability. Moreover, an end part of the connecting plate 400 has a forked configuration so as to contact at multiple points.

In addition, the extending section 404 of the connecting plate 400 is capable of elastically deform, slightly curving upward, and with the elastic force, it is possible to enhance reliability of contact with the central conductive member 701*a* of the coaxial plug 700*a*. Moreover, upon contacting with the central conductive member 701*a*, since the extending section 404 is pressed down such that the contact section 402 of the connecting plate 400 and the contact section 504 of the switching spring member 500 slide to contact, it is possible to further obtain wiping (cleaning) effect of the contact sections 402 and 504. Here, the insulating hosing 200 can be divided into, for example, two components (200*a* and 200*b*), so that it is suitable to incorporate an elastic piece that extends upward such as an elastic section 503 of the switching spring member 500, which will be described later.

Figure 5A:
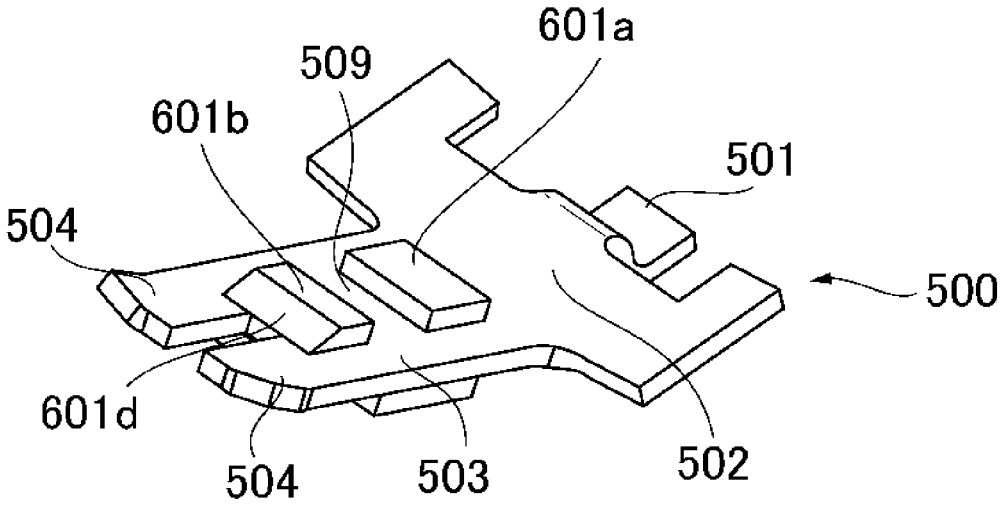
FIGS. 5(*a*) and 5(*b*) are perspective views showing a configuration example of a switching spring member of the coaxial connector, in which an insulation member is integrally molded therewith, wherein FIG. 5(*a*) is the one viewed from thereabove and FIG. 5(*b*) is the one viewed from therebelow.
Figure 5B:
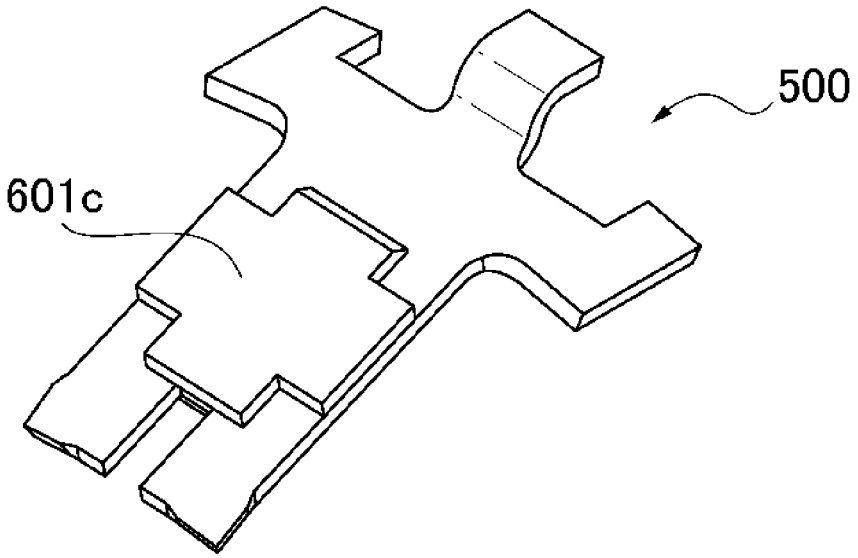
Figure 6A:
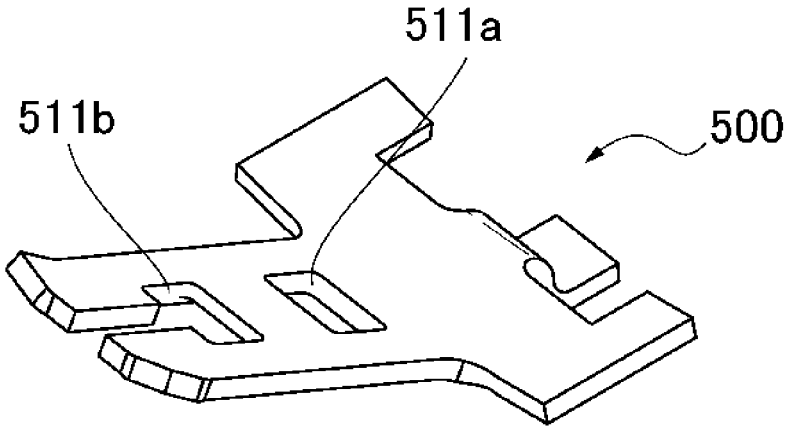
FIGS. 6(*a*) and 6(*b*) are perspective views showing the configuration example of the switching spring member of the coaxial connector, before the insulation member is integrally molded therewith, wherein FIG. 6(*a*) is the one viewed from thereabove and FIG. 6(*b*) is the one viewed from therebelow.
Figure 6B:
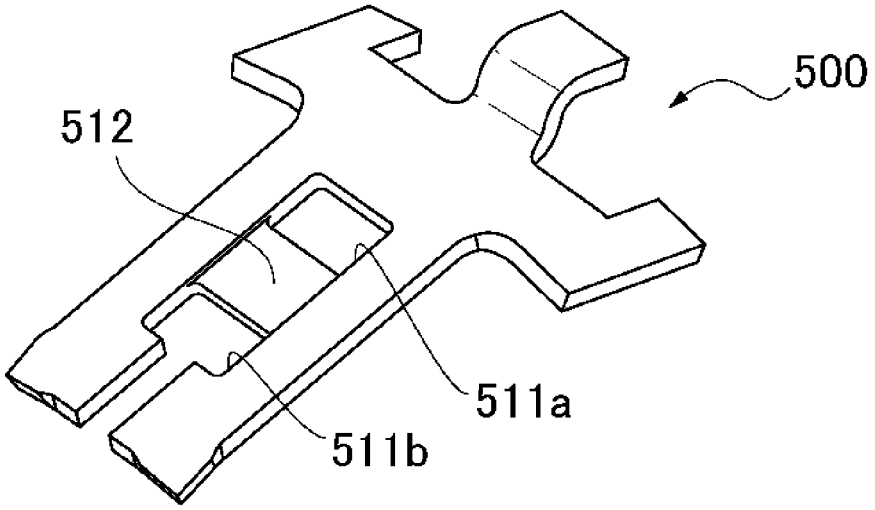

FIGS. 5(*a*) and 5(*b*) are perspective view showing a configuration example of a switching spring member 500 (finished component), in which an insulation member 601 is integrally molded therewith, wherein FIG. 5(*a*) is the one viewed from thereabove and FIG. 5(*b*) is the one viewed from therebelow. FIGS. 6(*a*) and 6(*b*) are perspective views showing a configuration example of the switching spring member 500 (terminal only), before the insulation member 601 is integrally molded therewith, wherein FIG. 6(*a*) is the one viewed from thereabove and FIG. 6(*b*) is the one viewed from therebelow.

In the embodiment, the switching spring member 500 may be formed, for example, by punching sheet metal of a conductive material, such as beryllium copper, phosphor bronze, ternary copper, and Corson copper and then bending. The switching spring member 500 includes a flat securing section 502; a substrate connecting section 501 that is formed being bent downward from a basal end side of the securing section 502; and an elastic section 503 that extends from the securing section 502 diagonally upward like a cantilever in the end direction.

In the embodiment, the contact section (second contact section) 509 provided at generally center of the elastic section 503 can touch a thin central conductive member 701*b* of the coaxial plug 700*b*, and has two contact sections (fourth contact section) 504 that are forked at end side relative to the touching position. The two contact sections 504 can contact with lower ends of the two contact sections (third contact section) 402 of the connecting plate 400.

On an upper surface of the switching spring member 500, there is formed an insulation member 601 (upper sections 601*a* and 601*b*) at a part that is off from a position an end of thin central conductive member 701*b* of the coaxial plug 700*b* and a part of an end of the central conductive member 701*a* having the outer extending section of the coaxial plug 700*a* touches. In addition, in the insulation member 601, the upper parts 601*a* and 601*b* are joined to the lower part 601*c* via the two holes 511*a* and 511*b* of the switching spring member 500 (see FIGS. 6(*a*) and 6(*b*)).

In the embodiment, the upper part 601*a* and the upper part 601*b* of the insulation member 601 are separated, and joined on a lower surface of the switching spring member 500 by the lower part 601*c*. Integrally molding the insulation member 601 having larger area than the holes 511*a* and 511*b* on the upper and lower surfaces of the switching spring member 500 so as to interpose therebetween, the insulation member 601 is fixed being in a state of engaging with the switching spring member 500 in the thickness direction (in a direction that an end part of the central conductive member 701*b* touches and presses), so that the insulation member 601 is strongly secured onto the switching spring member 500, and thereby the insulation member 601 hardly comes off from the switching spring member 500.

In the embodiment, the joining section 512 between the hole 511*a* and the hole 511*b* under the switching spring member 500 is made even thinner, so as to be able to enhance flowability of molding material upon integral molding of resin and secure enough thickness of the molded material. In addition, on the insulating section 601*b* near the connecting plate 400, there is provided a slope 601*d* so as to avoid interference with the connecting plate 400.

With this configuration, when the coaxial plug is not inserted, the contact between the third contact section 402 and the fourth contact section 504 is not inhibited. With a configuration of connecting the two insulating sections 601*a* and 601*b*, securing strength is enhanced, and by further filling the backside parts, which are pressed with the central conductive member of the coaxial plug, with resin, it is possible to prevent plastic deformation of the spring.

Figure 7:
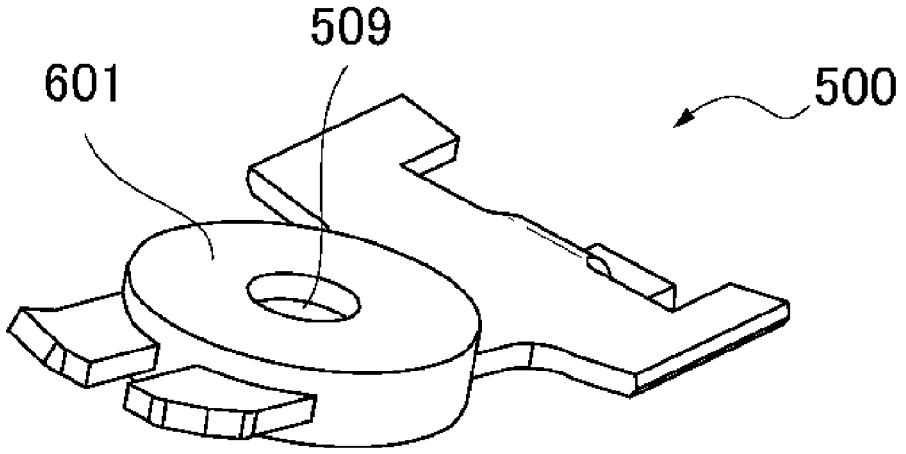
FIG. 7 is a perspective view showing a first modification example of the switching spring member of the coaxial connector, in which an insulation member is integrally molded therewith.
Figure 8:
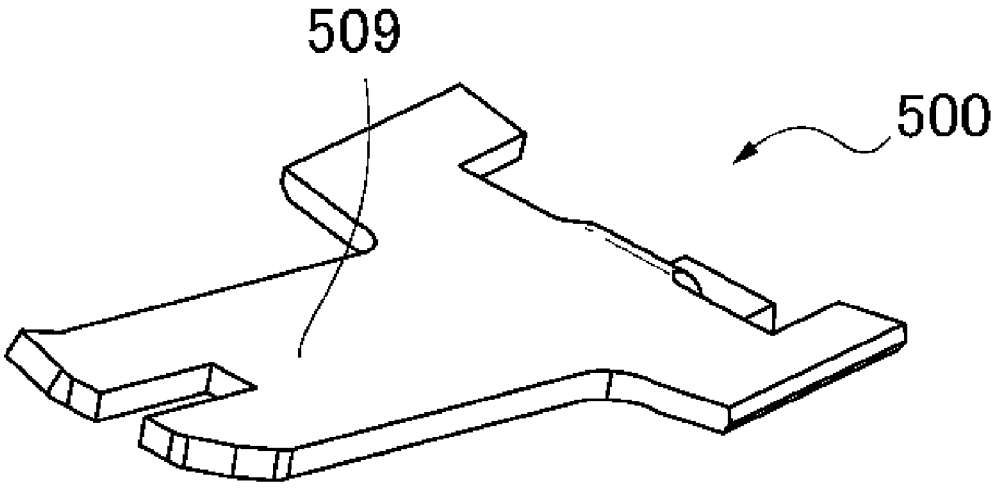
FIG. 8 is a perspective view showing the first modification example of the switching spring member of the coaxial connector, before the insulation member is integrally molded therewith.

FIGS. 7-12 are perspective views of modification examples of the switching spring member 500. FIGS. 7(*a*) and 7(*b*) are perspective views showing a first modification example of the switching spring member 500 (finished component), in which the insulation member 601 is integrally formed with; and FIG. 8 is a perspective view showing a first modification example of the switching spring member (terminal only), before the insulation member 601 is integrally molded therewith. As shown in FIGS. 7(*a*) and 7(*b*), it is also possible to form a donut-shaped insulation member 601 by integral molding so as to sandwich both surfaces of the switching spring member 500.

Figure 9A:
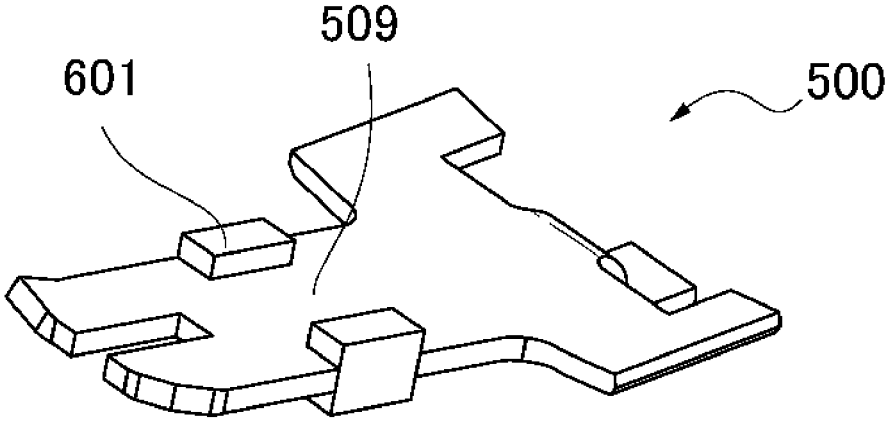
FIGS. 9(*a*) and 9(*b*) are perspective views showing a second modification example of the switching spring member of the coaxial connector, in which an insulation member is integrally molded therewith, wherein FIG. 9(*a*) is the one viewed from thereabove and FIG. 9(*b*) is the one viewed from therebelow.
Figure 9B:
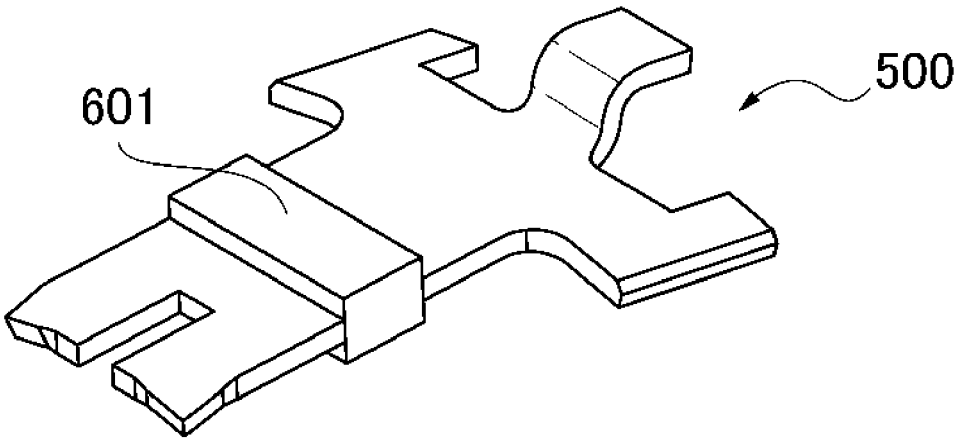
Figure 10:
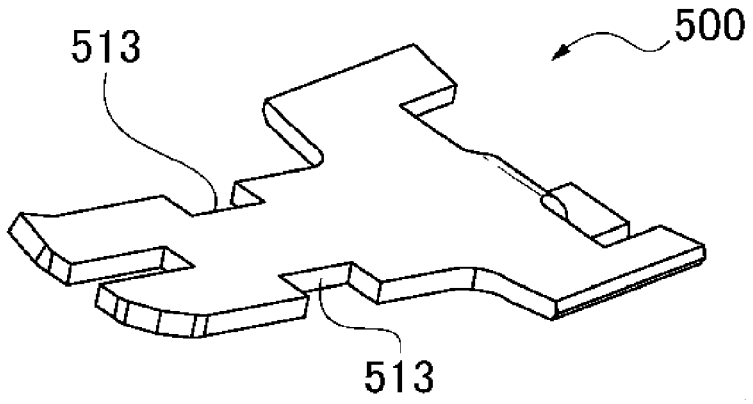
FIG. 10 is a perspective view showing the second modification example of the switching spring member of the coaxial connector, before an insulating section is integrally molded therewith.

FIGS. 9(*a*) and 9(*b*) are perspective view showing a second modification example of a switching spring member (finished component), in which the insulation member 601 is integrally molded therewith, wherein FIG. 9(*a*) is the one viewed from thereabove and FIG. 9(*b*) is the one viewed from therebelow. FIG. 10 is a perspective view showing a second modification example of the switching spring member 500, before the insulation member 601 is integrally molded therewith. As shown in FIGS. 9(*a*)-9(*b*) and 10, it is also possible to form a cutaway section 513 on both sides of the switching spring member 500 and form a strip-shaped insulation member 601 by integral molding so as to hold the cutaway sections 513 from the both sides.

Figure 11A:
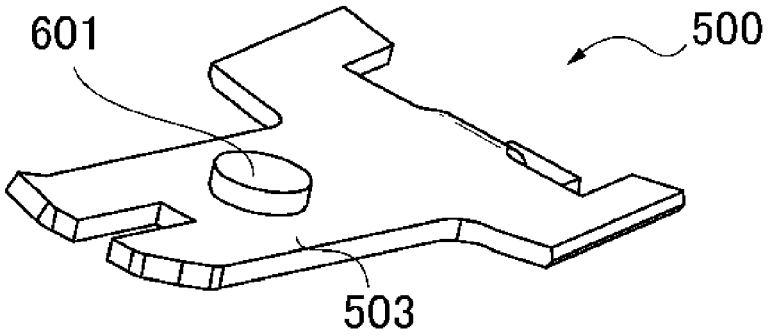
FIGS. 11(*a*) and 11(*b*) are perspective views showing a third modification example of the switching spring member of the coaxial connector, in which the insulation member is integrally molded therewith, wherein FIG. 11(*a*) is the one viewed from thereabove and FIG. 11(*b*) is the one viewed from therebelow.
Figure 11B:
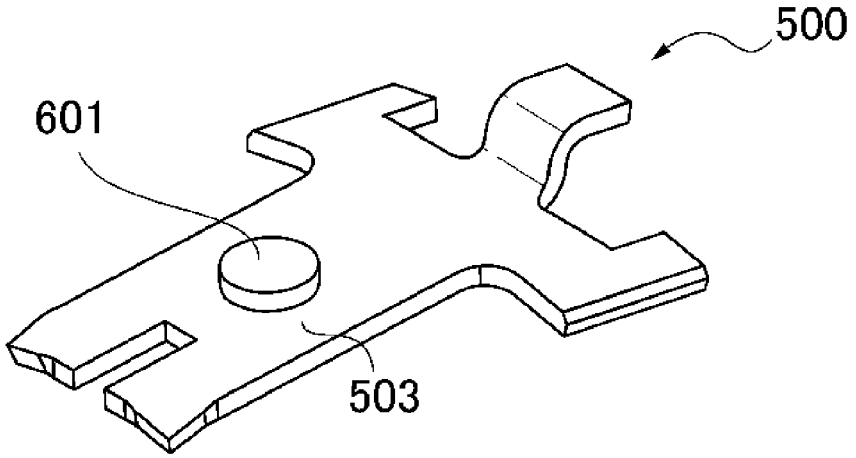
Figure 12:
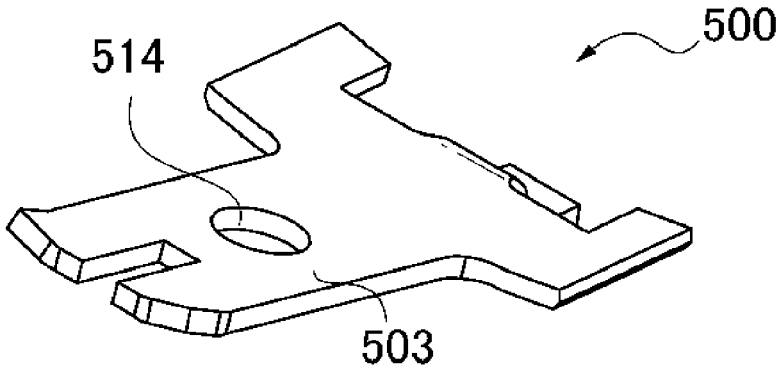
FIG. 12 is a perspective view showing the third modification example of the switching spring member of the coaxial connector, before an insulation member is integrally molded therewith.

FIGS. 11(*a*) and 11(*b*) are perspective views showing a third modification example of the switching spring member, in which an insulating section is integrally molded therewith, wherein FIG. 11(*a*) is the one viewed from thereabove and FIG. 11(*b*) is the one viewed from therebelow. FIG. 12 is a perspective view showing a third modification example of the switching spring member 500, before an insulation member 601 is integrally molded therewith.

As shown in FIGS. 11(*a*)-11(b) and 12, it is possible to form the insulation member 601 by providing a hole 514 in the contact section 509 of the elastic section 503 of the switching spring member 500 and then integral molding the insulation member 601 on upper and lower surfaces of the switching spring member 500 through the hole 514. Here, having the diameter of the insulation member 601 larger than that of the hole 514, it is possible to prevent coming off of the insulation member 601.

In case of the third modification example, there is formed a recess (concave section) at a center part of an end section of the thin central conductive member 701*b* of the coaxial plug 700*b*, which is a part that touches the insulation member 601, and by having the periphery around the end part of the central conductive member 701*b* cylindrically protrude, only the periphery contacts with the switching spring member 500 upon fitting of the coaxial plug, while avoiding interference with the insulation member 601. In addition, there is formed a protrusion (convex section) at a center part of an end part of the thick central conductive member 701*a* of the coaxial plug 700*a*, which is a part that touches the insulation member 601, such that the protrusion presses down the switching spring member 500 upon fitting the coaxial plug and thereby only the periphery part of central conductive member 701*a* contacts with the connecting plate 400.

Figure 13A:
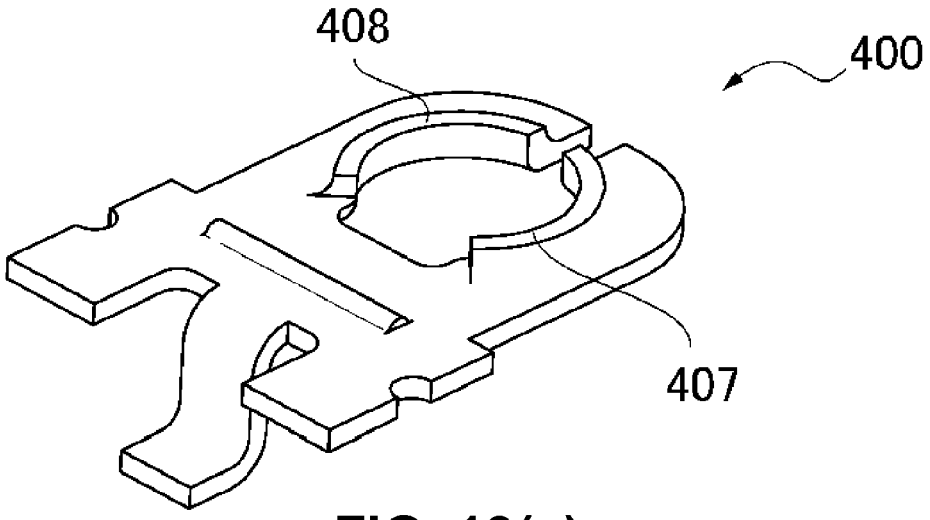
FIGS. 13(*a*) and 13(*b*) are perspective views of a modification example of a connecting plate of the coaxial connector, wherein FIG. 13(*a*) is the one viewed from thereabove and FIG. 13(*b*) is the one viewed from therebelow.
Figure 13B:
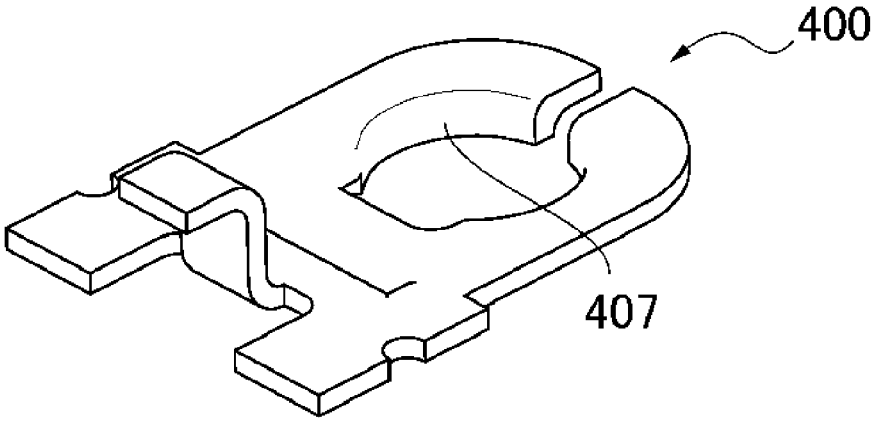

FIGS. 13(*a*) and 13(*b*) are perspective views of a modification example of the connecting plate 400, wherein FIG. 13(*a*) is the one viewed from thereabove and FIG. 13(*b*) is the one viewed from therebelow.

As shown in FIGS. 13(*a*) and 13(*b*) are, it is also possible to form the connecting plate 400 by stamping the contact section 408 around the hole 407 such that the contact section 408 around the hole 407 is formed in a shape that protrudes on the upper surface side. At this time, providing a slope on an upper surface of the protrusion to form an edge section, it is possible to prevent adhesion of foreign substances such as dirt on the surface.

Figure 14:
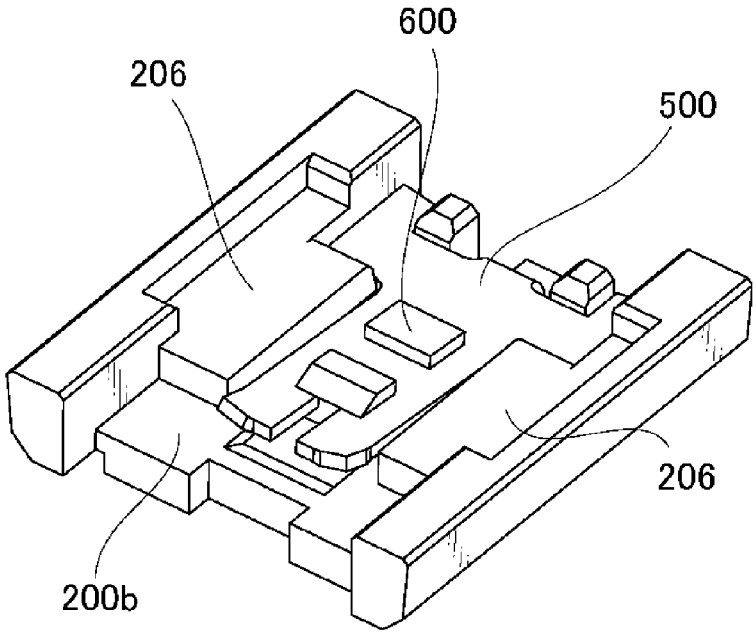
FIG. 14 is a perspective view showing a configuration of a combination of a lower insulation housing and the switching spring member of the coaxial connector.
Figure 15:
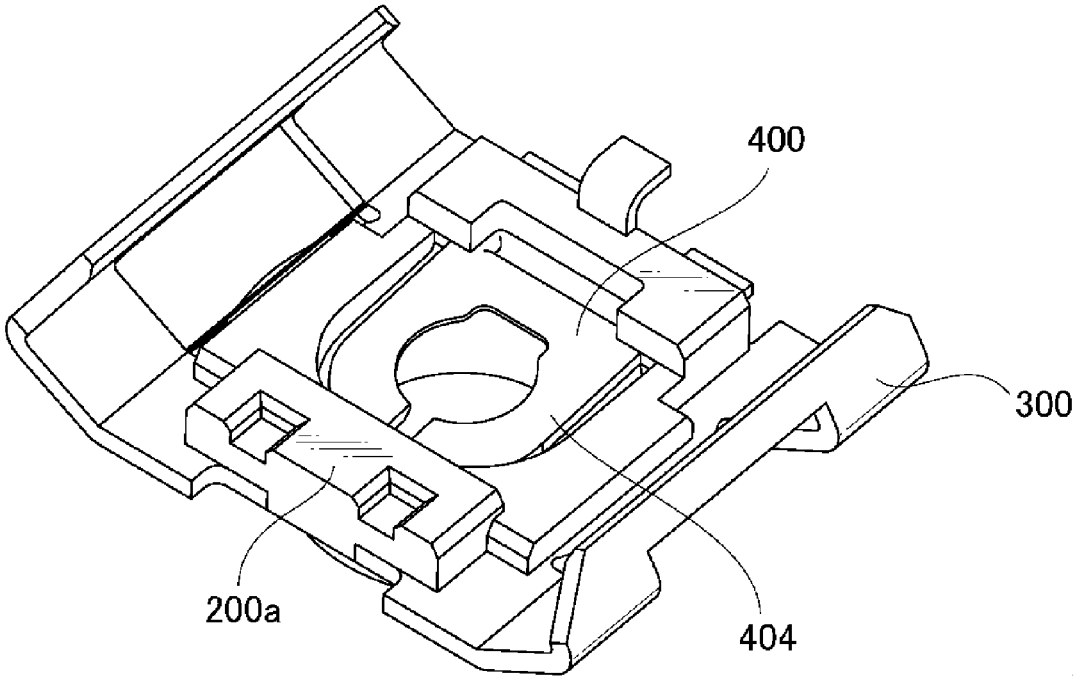
FIG. 15 is a perspective view showing a configuration of a combination of an upper insulation housing, a connecting plate, and an outer conductive member of the coaxial connector.

FIG. 14 is a perspective view showing a configuration with a combination of a lower insulation housing 200*b* and the switching spring member 500. Those components can be made by assembling parts or made by integral injection molding of resin or the like in a die. FIG. 15 is a perspective view showing a configuration with a combination of an upper insulation housing 200*a*, the connecting plate 400, and the outer conductive member 300 in a state of being flipped over. Those components can be made by assembling parts or made by integral injection molding of resin or the like in a die.

In the embodiment, the coaxial connector 100 can be assembled by flipping the configuration of FIG. 15, then putting it over the configuration of FIG. 14, and crimping both sides of the outer conductive member 300. Moreover, a support section 206 of the lower insulation housing 200*b* is configured to be able to interfere with both edges of the extending section 404 of the connecting plate 400, so that even if the connecting plate 400 is pressed down with strong force upon fitting the coaxial plug, the connecting plate 400 can move downward only for a specific amount because of the support section 206.

Figure 16A:
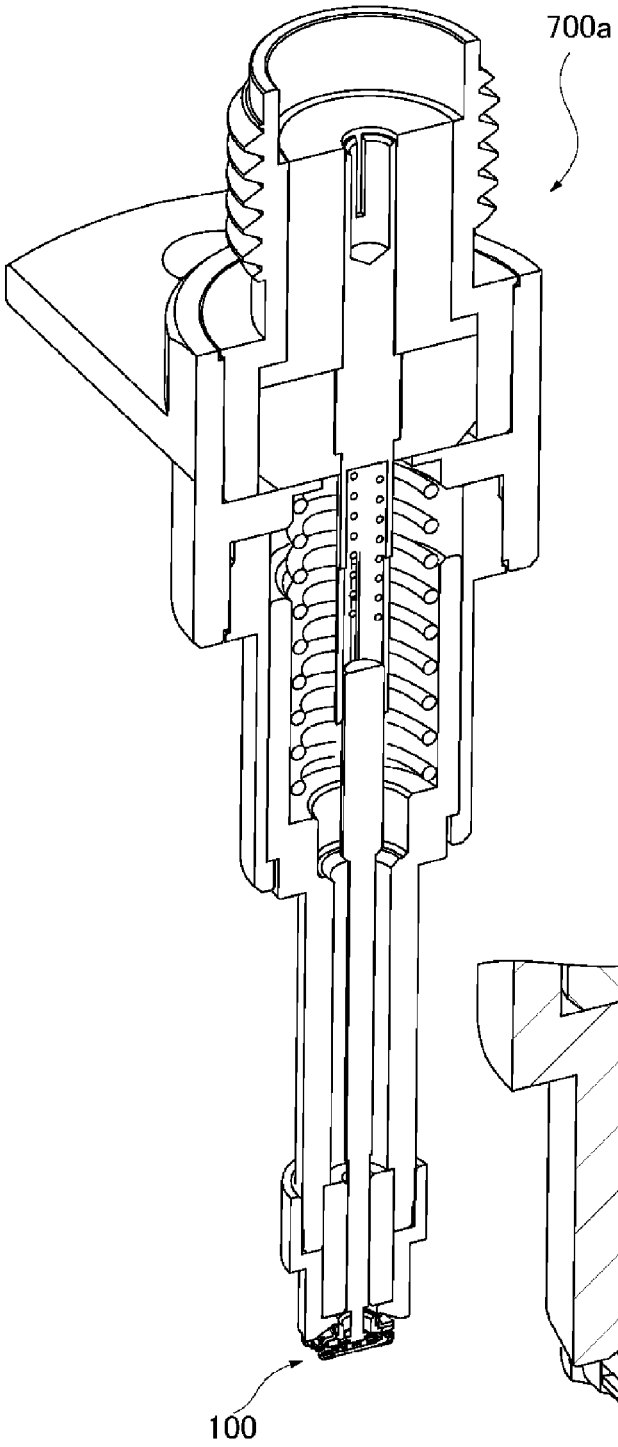
FIGS. 16(*a*) and 16(*b*) are views showing the coaxial connector in a state where a coaxial plug with an outer extending section is fitted in the coaxial connector, wherein FIG. 16(*a*) is a whole view and FIG. 16(*b*) is an enlarged sectional view near the coaxial connector.
Figure 16B:
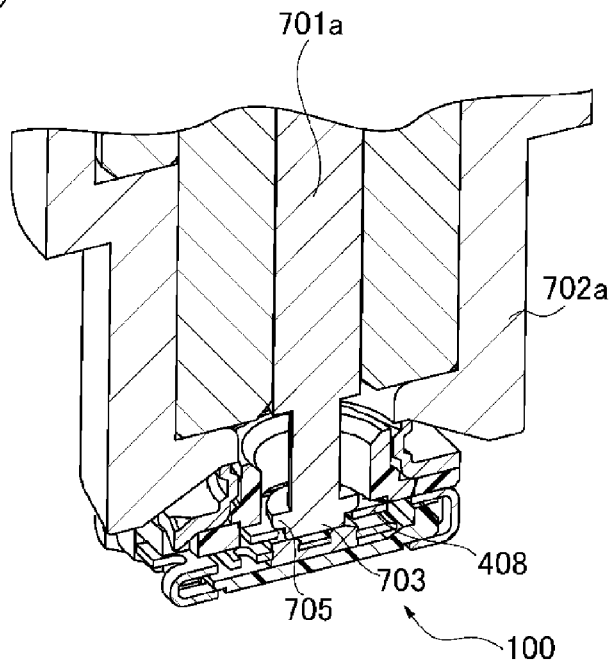
Figure 17A:
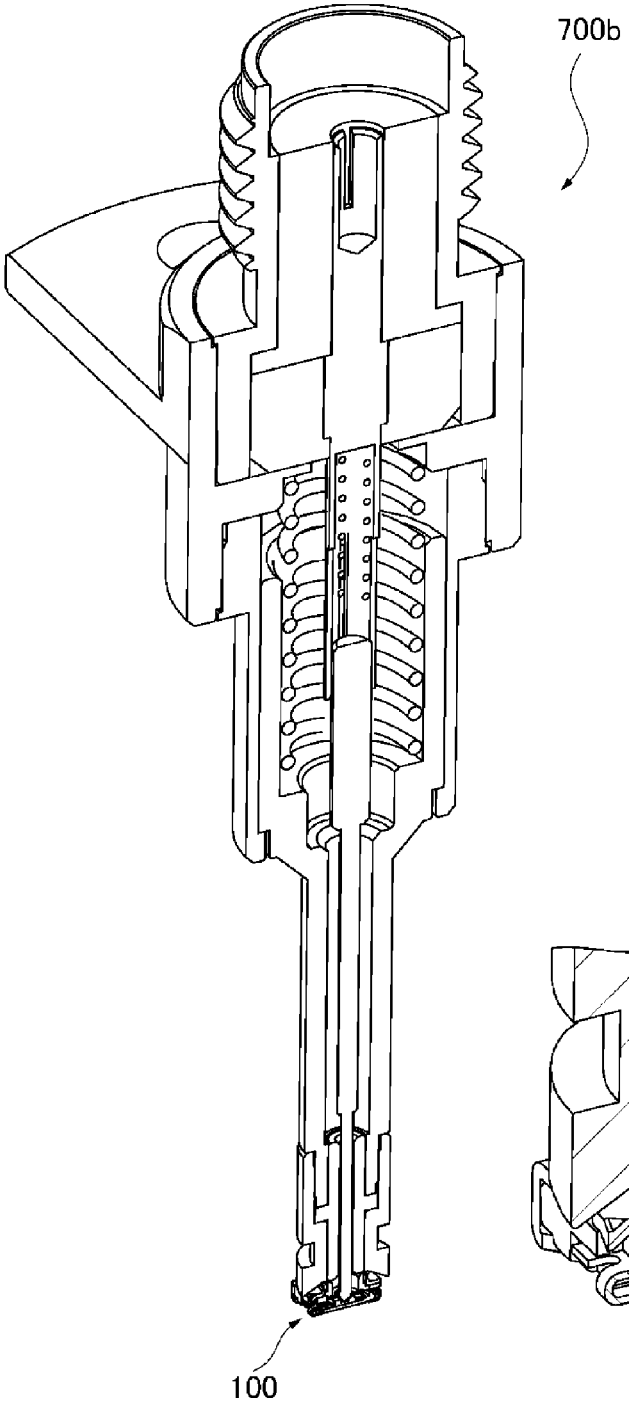
FIGS. 17(*a*) and 17(*b*) are views showing the coaxial connector in a state where a coaxial plug without an outer extending section is fitted in the coaxial connector, wherein FIG. 17(*a*) is a whole view and FIG. 17(*b*) is an enlarged sectional view near the coaxial connector.
Figure 17B:
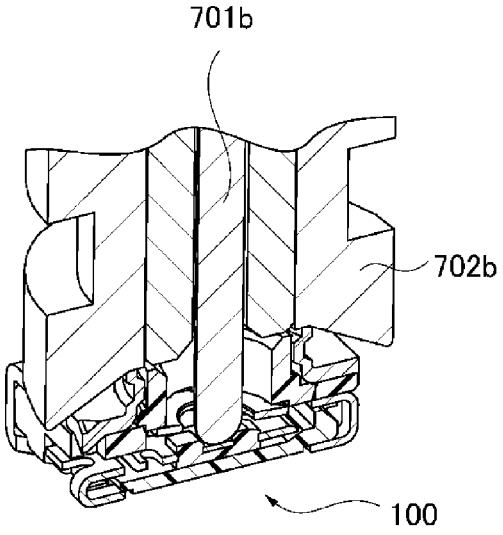

FIGS. 16(*a*) and 16(*b*) are views showing a state where a coaxial plug 700*a* with an outer extending section 705 is fitted in the coaxial connector 100, wherein FIG. 16(*a*) is a whole view and FIG. 16(*b*) is an enlarged sectional view near the coaxial connector 100. FIGS. 17(*a*) and 17(*b*) are views showing a state where a coaxial plug 700*b* without an outer extending section is fitted in the coaxial connector 100, wherein FIG. 17(*a*) is a whole view and FIG. 17(*b*) is an enlarged sectional view near the coaxial connector 100.

In inspection, coaxial plugs having at least two types of end sections are used. Here, in this specification, an "end section" of a central conductive member refers to an end section of the central conductive member in an axial direction thereof, which is a part to be inserted in the vertical hole of the coaxial connector. In addition, an "end part" of the central conductive member is a part of the "end section", which is a part that touches the switching spring member. Furthermore, an "outer extending section" is a part of the "end section", which is an annular part that is provided around the "end part" and extends in a diametric direction of the central conductive member.

In case of electrically disconnecting between the connecting plate 400 and switching spring member 500 and electrically connecting between the connecting plate 400 and the central conductive member of the coaxial plug in order to measure antenna characteristics or the like, a first coaxial plug 700*a*, in which an end section of the central conductive member has a large diameter, is used.

As shown in FIG. 16(*b*), the end part of the coaxial plug 700*a* has an annular protrusion 703, a sectional view of which has a step-like shape, and which protrudes downward from a lower end position of the outer extending section 705. The protrusion 703 is provided at a position so as to go through the hole 407 of the connecting plate 400, and the outer circumferential part of the protrusion 703 is made to have larger diameter than that of the hole 407 and forms the outer extending section 705.

In the embodiment, the protrusion 703 is configured to touch the insulating sections 601*a* and 601*b* on the switching spring member 500. With the thickness of the insulating sections, the central conductive member 701*a* is configured not to contact with the contact section 509 of the switching spring member 500. In addition, the outer extending section 705 of the central conductive member 701*a* is configured to touch the contact section 408 of the connecting plate 400 upon inserting the coaxial plug 700*a*.

Moreover, the coaxial plug is elastically supported to the plug main body, such that the outer conductive member 702*a* or 702*b* can displace in an up-and-down direction with the plug insulating body, and the central conductive member is also independently elastically supported so as to be capable of displacing.

In case of electrically disconnecting between the connecting plate 400 and the switching spring member 500 and electrically connecting between the switching spring member 500 and the central conductive member of the coaxial plug in order to measure characteristics of high-frequency circuit or the like, a second coaxial plug 700*b*, in which an end section of the center connector has a smaller diameter than that of the first coaxial plug 700*a*, is used.

In the embodiment, the diameter of the end section of the central conductive member 701*b* of the second coaxial plug 700*b* is smaller than that of the hole 407 of the connecting plate 400 so as to be able to go through the hole 407. The end section of the central conductive member 701*b* is configured to touch the contact section 509 of the switching spring member 500. Here, the connecting relation between the antenna and the high-frequency circuit can be opposite to that described above.

When the coaxial plug 700*a* or 700*b* is not attached, the contact section (fourth contact section) 504 of the switching spring member 500 is pressed onto the contact section (third contact section) 402 of the connecting plate 400 by elastic force of the elastic section 503, and the connecting plate 400 and the switching spring member 500 keep the electrically connected state.

When the first coaxial plug 700*a* having the outer extending section 705 is attached, a lower end section of the outer conductive member 702*a* of the first coaxial plug 700*a* touches the outer conductive member 300, and the end section of the central conductive member 701*a* of the coaxial plug 700*a* is put through the vertical hole 203. In this state, the protrusion 703 of the end part of the central conductive member 701*a* of the coaxial plug 700*a* touches the insulation member 601 of the elastic section 503. At this time, since the elastic force of the central conductive member 701*a* of the coaxial plug 700*a* is stronger than that of the elastic section 503, the elastic section 503 is pressed down by the central conductive member 701*a* of the coaxial plug 700*a* to elastically deform, the contact section 504 moves away from the contact section 402, and the connecting plate 400 and the switching spring member 500 are electrically disconnected.

At the same time, the outer extending section 705 of the end section of the central conductive member 701*a* of the coaxial plug 700*a* touches the contact section (first contact section) 408 of the outer edge of the hole 407 of the extending section 404 of the first terminal 400, and the central conductive member 701*a* of the coaxial plug 700*a* and the connecting plate 400 are in connected state. As such, it is possible to flow signals, which flew from the connecting plate 400 to the switching spring member 500, from the connecting plate 400 to the central conductive member 701*a* of the coaxial plug 700*a* so as to be able to inspect the antenna.

In the embodiment, the second contact section 509, the fourth contact section 504, and the insulation member 601 are preferably in positions relative to each other so as to block the connection between the third contact section 402 and the fourth contact section 504. More specifically, since there is provided the fourth contact section 504 on a free end side of the cantilever-like second terminal 500, and the insulation member 601 touches at near the basal section side thereof relative to the position of the contact section, the amount of deformation of the fourth contact section 504, which is on the free end side, is greater than that of the touched section.

When the second coaxial plug 700*b* having a central conductive member, in which an end section has a small diameter, is attached, a lower end of the outer conductive member 702*b* of the second coaxial plug 700*b* touches the outer conductive member 300, and an end section of the central conductive member 701*b* of the coaxial plug 700*b* is put through the vertical hole 203. In this state, the central conductive member 701*b* of the coaxial plug 700*b* touches the contact section (second contact section) 509 of the elastic section 503.

At this time, since elastic force of the central conductive member 701*b* of the coaxial plug 700*b* is stronger than that of the elastic section 503, the elastic section 503 is pressed down by the central conductive member 701*b* of the coaxial plug 700*b* and elastically deforms, and the contact section 504 moves away from the contact section 402, so that the connecting plate 400 and switching spring member 500 are electrically disconnected, and the central conductive member 701*b* of the coaxial plug 700*b* and the switching spring member 500 are in a connected state. As such, signals, which flew from the switching spring member 500 to the connecting plate 400, are made flow from the switching spring member 500 to the central conductive member 701*b* of the coaxial plug 700*b*, and it is possible to inspect the high-frequency circuit.

FIGS. 18-22 are views showing a configuration, in which an insulation member 601 is provided on a lower surface of the connecting plate 400 of the coaxial connector, according to another embodiment.

Figure 18:
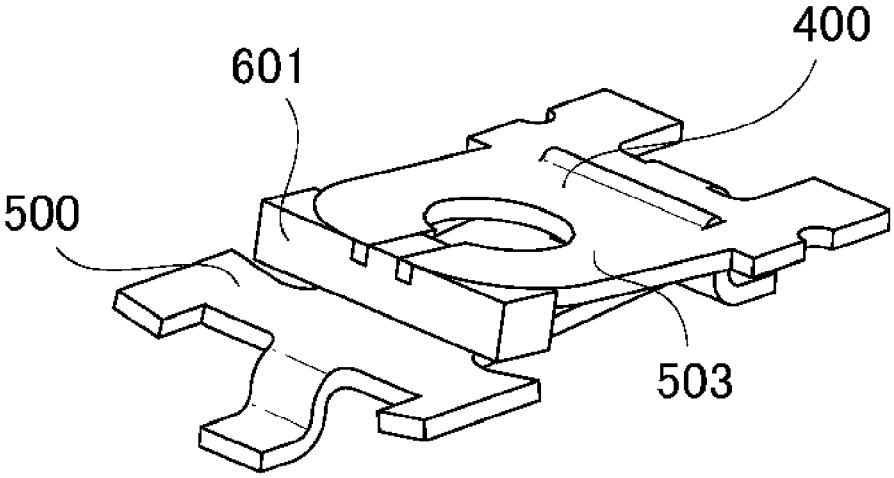
FIG. 18 is a perspective view showing a configuration of an insulation member provided on a lower surface of the connecting plate of the coaxial connector.
Figure 19A:
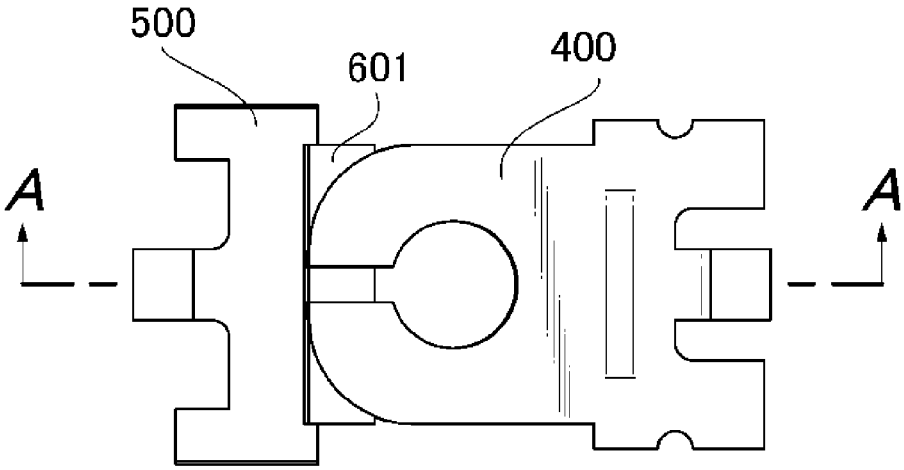
FIGS. 19(*a*) and 19(*b*) are views showing a configuration of the insulating material provided on the lower surface of the connecting plate of the coaxial connector according to the embodiment of FIG. 18, wherein FIG. 19(*a*) is a top view thereof and FIG. 19(*b*) is a sectional view thereof taken along a line A-A in FIG. 19(*a*)
Figure 19B:
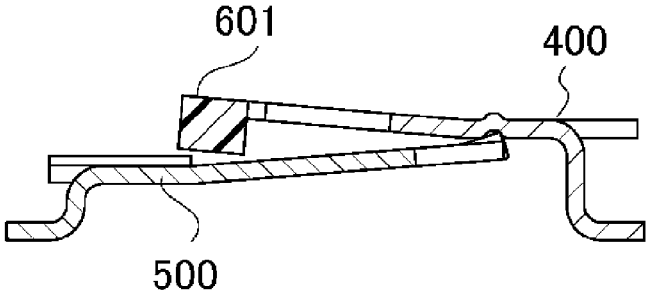

As shown in FIGS. 18 and 19(*a*)-19(*b*), it is also possible to provide the insulation member 601 on a lower surface of the end part of the elastic section 503 of the connecting plate 400. In this case, as the connecting plate 400 is pressed down by the outer extending section 705 of the central conductive member, which has a large diameter, the switching spring member 500 is also pressed down by operation of the insulation member 601, and thereby it is possible to block contact between the connecting plate 400 and the switching spring member 500. More specifically, even in case of a central conductive member that does not have the protrusion 703 as shown in FIG. 16, without directly pressing down the insulation member 601 with the central conductive member 701*a* or 701*b*, it is possible to shut off electrical connection between the connecting plate 400 and the switching spring member 500.

Figure 20:
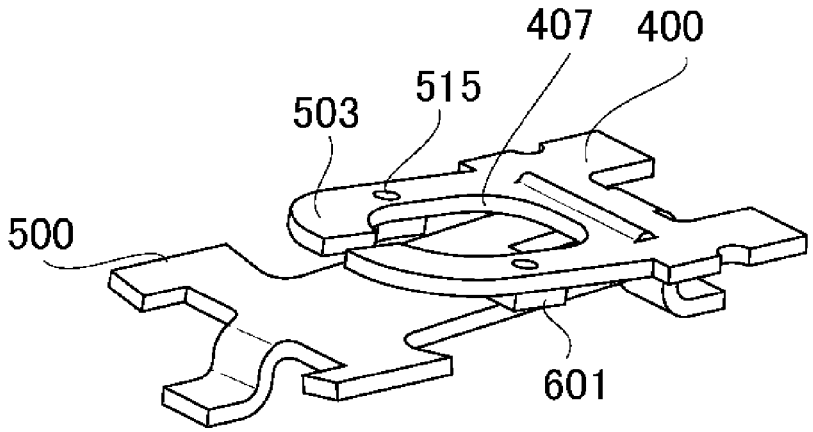
FIG. 20 is a perspective view showing the insulation member provided on the lower surface of the connecting plate of the coaxial connector according to another embodiment of the present invention.
Figure 21A:
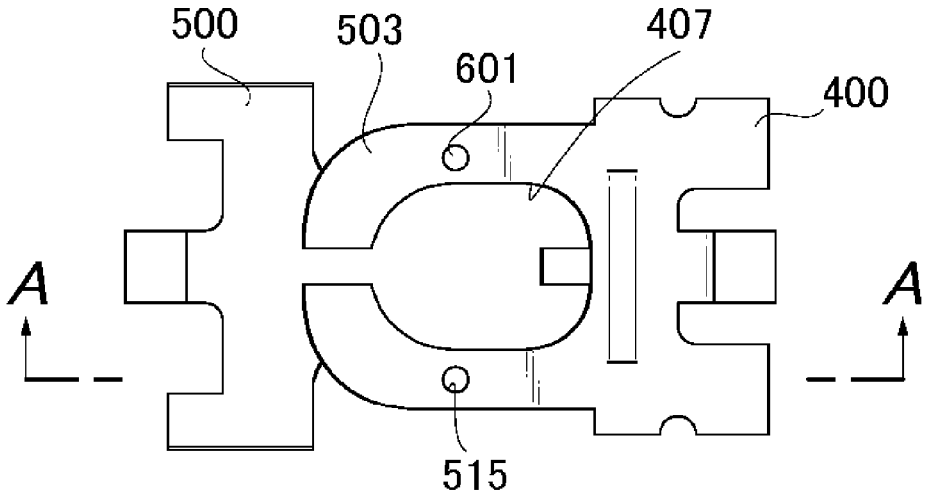
FIGS. 21(*a*) and 21(*b*) are views showing a configuration of the insulation member provided on the lower surface of the connecting plate of the coaxial connector according to the embodiment of FIG. 20, wherein FIG. 21(*a*) is a top view thereof and FIG. 21(*b*) is a sectional view thereof taken along a line A-A in FIG. 21(*a*)
Figure 21B:
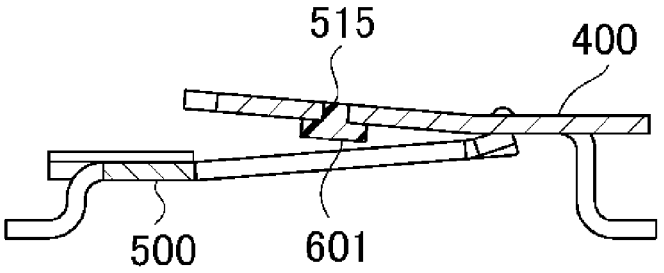

FIGS. 20 and 21(*a*)-21(*b*) are views showing another configuration example of the insulation member provided on the lower surface of the connecting plate of the coaxial connector according to another embodiment of the present invention, similarly to FIGS. 18 and 19(*a*)-19(*b*).

As shown in FIGS. 20 and 21(*a*)-21(B), it is also possible to make a hole 515 at two positions around the hole 407 of the elastic section 503 of the connecting plate 400 and form the insulation member 601 so as to fit in the holes 515 from a lower surface of the connecting plate 400. In this case, as the connecting plate 400 is pressed down by the central conductive member having a large diameter, the switching spring member 500 is also pressed down by operation of the insulation member 601, and thereby it is possible to shut off the contact between the connecting plate 400 and the switching spring member 500.

More specifically, even in case of a central conductive member without the protrusion 703 as shown in FIG. 16, it is possible to shut off the electrical connection between the connecting plate 400 and the switching spring member 500, without directly pressing the insulation member 601 by the central conductive member 701*a* or 701*b*.

Figure 22:
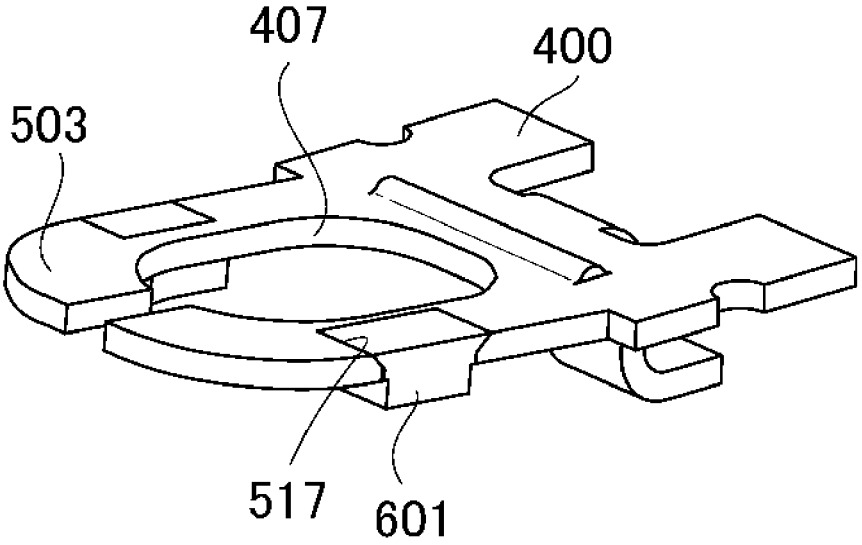
FIG. 22 is a perspective view showing a configuration of the insulation member on the lower surface of the coaxial connector according to another embodiment of the present invention.

FIG. 22 is a perspective view showing another configuration of the connecting plate similarly to FIGS. 20 and 21(*a*)-21(*b*). As shown in FIG. 22, it is also possible to provide cutaway section 517 at two positions around the hole 407 of the elastic section 503 of the connecting plate 400, and form the insulation member 601 so as to fit in the cutaway sections 517 from sides of the connecting plate 400. Each cutaway section 517 has a tapered shape such that the upper surface of the connecting plate 400 is the widest and becomes narrow as it is close to the lower surface thereof. Forming the insulation member 601 in such shape, the insulation member 601 is engaged and fixed in the thickness direction of the connecting plate 400, which makes the insulation member 601 hardly come off therefrom.

Moreover, it is also possible to obtain similar effects by forming in a shape of a dovetail groove or zigzag (serrate)-shape instead of the tapered shape. In this case, as the connecting plate 400 is pressed down with the central conductive member having a large diameter, the switching spring member 500 is also pressed down by operation of the insulation member 601 and thereby it is possible to shut off the contact between the connecting plate 400 and the changeover switch 500.

More specifically, even in case of the central conductive member without the protrusion 703 as shown in FIG. 16, it is possible to shut off the electrical connection between the connecting plate 400 and the switching spring member 500 without directly pressing down the insulation member 601 by the central conductive member 701*a* or 701*b*.

As shown in FIGS. 20-22, in case of pressing the connecting plate 400 to press down the switching spring member 500 via the insulation member 601, when the elastic section 503 is configured as a plurality of pieces, there is a benefit of pressing down the switching spring member 500 with other piece, even when one of the pieces does not appropriately presses down.

FIGS. 18-22 show configuration examples, in which the insulation member 601 is provided on a lower surface of the connecting plate 400 of the coaxial connector, as modification examples, but it is also possible to obtain similar effects even by providing the insulation member 601 on the switching spring member 500 instead of the connecting plate 400. For example, it is possible to provide the insulation member 601 so as to project on both sides of the elastic section 503 of the switching spring member 500, such that the switching spring member 500 displaces based on the pressing of the connecting plate 400 and deformation.

As shown in Examples of FIGS. 18-22, the insulation member 601 can be attached by making a hole on the switching spring member 500 and engaging and fixing the insulation member 601 therein, providing a slope to engage and fix thereto, providing a cutaway section to engage and fix therein, or forming in a shape of dovetail groove or zigzag (serrate)-shape to engage and fix thereto. In addition, as shown in the embodiment of FIG. 20, the insulation member 601 on the lower surface side of the switching spring member 500 can be engaged and fixed within the thickness by the dovetail groove shape so as not to protrude from the surface. With those configurations, similarly to Examples of FIGS. 18-22, the coaxial plug does not directly contact and press the insulation member, so that it is possible to prevent damage of the insulating material.

Therefore, according to the coaxial connector of the above-described embodiment, it is possible to switch among a plurality of terminals, while having a configuration that can attain high productivity, low manufacturing cost, and high durability. In addition, there is no restriction in a rotational angle upon insertion/attachment and the operability is enhanced. In addition, by integrally molding the insulation member, it is possible to attain high productivity. Moreover, it is possible to block space with the insulation member and prevent entrance of dirt.

In the above description, the present invention made by the inventors is explained in detail based on the embodiments, but it should be understood that the present invention shall not be limited to those embodiments, and needless to say, can be varied, altered, or modified within scope of the present invention. Furthermore, it is also possible to suitably combine a part of the plurality of embodiments.

The coaxial connector having a switch according to the present invention can be applied in a wide variety of industrial areas including information communication device industries, such as cellular phones, smartphones, PDA, and tablet-type personal computers.

The disclosure of Japanese Patent Application No. 2013-056270 filed on Mar. 19, 2013, is incorporated in the application by reference.

While the invention has been explained with reference to the specific embodiments of the invention, the explanation is illustrative and the invention is limited only by the appended claims.

What is claimed is:

1. A coaxial connector to be mounted on a board, comprising:

an insulation housing having a receptacle opening portion for receiving a central conductive member of a coaxial plug;

an outer conductive member disposed outside the insulation housing for detachably attaching an outer conductive member of the coaxial plug;

a connection member exposed inside the receptacle opening portion;

a switching spring member disposed below the connection member and capable of being elastically deformed downwardly when the insulation housing receives the central conductive member; and an insulation member fixed to at least one of the connection member and the switching spring member so that the insulation member is situated between the connection member and the switching spring member, wherein said switching spring member is configured to be pushed and displaced so that the switching spring member is disconnected from the connection member when the coaxial plug is inserted into the insulation housing, or said connection member is configured to be pushed to displace the switching spring member through the insulation member so that the switching spring member is disconnected from the connection member when the coaxial plug is inserted into the insulation housing.

2. The coaxial connector according to claim 1, wherein said insulation member includes an upper portion and a lower portion connected to the upper portion, said upper portion is exposed from an upper surface of the at least one of the connection member and the switching spring member, and said lower portion is exposed from a lower surface of the at least one of the connection member and the switching spring member.

3. The coaxial connector according to claim 2, wherein said at least one of the connection member and the switching spring member includes a hole portion so that the upper portion is connected to the lower portion through the hole portion.

4. The coaxial connector according to claim 2, wherein said at least one of the connection member and the switching spring member includes a cut portion in a side surface thereof so that the upper portion is connected to the lower portion through the cut portion.

5. The coaxial connector according to claim 1, wherein said insulation member is formed of a resin member integrated with the at least one of the connection member and the switching spring member.

6. The coaxial connector according to claim 1, wherein said connection member is configured to be capable of being elastically deformed.

7. The coaxial connector according to claim 1, wherein said connection member is configured to be incapable of being elastically deformed.

8. A coaxial connector to be mounted on a board and connected to a first coaxial plug or a second coaxial plug, comprising:

an insulation housing having a receptacle opening portion for receiving a first central conductive member of the first coaxial plug or a second central conductive member of the second coaxial plug;

an outer conductive member disposed outside the insulation housing for detachably attaching a first outer conductive member of the first coaxial plug or a second outer conductive member of the second coaxial plug;

a connection member disposed below the receptacle opening portion and capable of being elastically deformed downwardly when the insulation housing receives the first central conductive member or the second central conductive member;

a switching spring member disposed below the connection member and capable of being elastically deformed downwardly when the insulation housing receives the first central conductive member or the second central conductive member; and an insulation member fixed to at least one of the connection member and the switching spring member so that the insulation member is situated between the connection member and the switching spring member, wherein said connection member includes a first contact portion on an upper surface thereof for contacting with an outer extended portion of the first central conductive member when the first coaxial plug is inserted into the insulation housing, said switching spring member includes a second contact portion on an upper surface thereof for contacting with the second central conductive member when the second coaxial plug is inserted into the insulation housing, said connection member further includes a third contact portion on a lower surface thereof, and said switching spring member further includes a fourth contact portion on an upper surface thereof for contacting with the third contact portion when any of the first coaxial plug and the second coaxial plug is not inserted into the insulation housing.

* * * * *